US006679212B2

(12) United States Patent
Kelling

(10) Patent No.: US 6,679,212 B2
(45) Date of Patent: Jan. 20, 2004

(54) CAPACITIVE REMOTE VEHICLE STARTER

(75) Inventor: Gordon L. Kelling, Minnetonka, MN (US)

(73) Assignee: Goodall Manufacturing, LLC, Eden Prairie, MN (US)

( * ) Notice: Subject to any disclaimer, the term of this patent is extended or adjusted under 35 U.S.C. 154(b) by 24 days.

(21) Appl. No.: 09/812,448

(22) Filed: Mar. 20, 2001

(65) Prior Publication Data

US 2001/0025618 A1 Oct. 4, 2001

Related U.S. Application Data

(60) Provisional application No. 60/191,963, filed on Mar. 24, 2000.

(51) Int. Cl.[7] ..... F02N 11/14
(52) U.S. Cl. ..... 123/179.28
(58) Field of Search ..... 123/179.1, 179.3, 123/179.28, 198 R; 290/50, 38 R; 320/103–105, 119, 166; 307/10.1, 10.6

(56) References Cited

U.S. PATENT DOCUMENTS

| | | | | | |
|---|---|---|---|---|---|
| 4,488,147 | A | * | 12/1984 | Signorile | 320/105 |
| 4,902,955 | A | * | 2/1990 | Manis et al. | 141/38 |
| 5,077,513 | A | * | 12/1991 | Dea et al. | 320/115 |
| 5,146,095 | A | * | 9/1992 | Tsuchiya et al. | 290/38 R |
| 5,155,373 | A | * | 10/1992 | Tsuchiya et al. | 123/179.1 |
| 5,157,267 | A | * | 10/1992 | Shirata et al. | 123/179.3 |
| 5,207,194 | A | * | 5/1993 | Clerici | 123/179.1 |
| 5,260,637 | A | * | 11/1993 | Pizzi | 320/103 |
| 5,371,455 | A | * | 12/1994 | Chen | 320/165 |
| 5,563,454 | A | * | 10/1996 | Araki et al. | 123/179.1 |
| 5,642,696 | A | * | 7/1997 | Matsui | 123/179.1 |
| 5,818,115 | A | * | 10/1998 | Nagao | 180/65.1 |
| 5,963,417 | A | * | 10/1999 | Anderson et al. | 29/25.03 |
| 6,018,199 | A | * | 1/2000 | Shiroyama et al. | 123/179.3 |
| 6,034,492 | A | * | 3/2000 | Saito et al. | 290/1 C |
| 6,163,088 | A | * | 12/2000 | Codina et al. | 307/109 |
| 6,212,054 | B1 | * | 4/2001 | Chan | 307/10.7 |
| 6,242,887 | B1 | * | 6/2001 | Burke | 318/556 |
| 6,325,035 | B1 | * | 12/2001 | Codina et al. | 123/179.1 |
| 6,362,595 | B1 | * | 3/2002 | Burke | 320/104 |
| 6,426,606 | B1 | * | 7/2002 | Purkey | 320/103 |

FOREIGN PATENT DOCUMENTS

JP 02175351 A * 7/1990 ..... B60R/16/04

OTHER PUBLICATIONS

KBi/Kold–Ban international, "KBi KAPower Installation Manual", pp. 1–11; Circa Jun. 2000; Lake In The Hills, IL.*
KBi/Koldban Int'l Ltd., "KAPower Super Capacitors", Brochure, pp. 1–4; Circa Dec. 2000; Lake In The Hills, IL.*
KBi/Koldban Int'l Ltd., "KrankingKart Professional Jump–Start Unit", Brochure, pp. 1–2; Circa Aug. 2001; Lake In The Hills, IL.*
Two–page note from Harold R. Grivna.
Introduction to Electrochemical (EC) Capacitors, Daniel O'Brien, 6 pages.

* cited by examiner

*Primary Examiner*—Hieu T. Vo
*Assistant Examiner*—Arnold Castro
(74) *Attorney, Agent, or Firm*—Patterson, Thuente, Skaar & Christensen, P.A.

(57) ABSTRACT

A remote vehicle starter with a capacitor for starting a vehicle by electrically connecting the vehicle starter directly or via the vehicle battery. The vehicle starter capacitor may be connected to a power source during a starting procedure, thereby remaining in a charged state and more effectively starting the vehicle. Optional circuitry, e.g., activating lights and a buzzer, may be present to warn the operator that incorrect vehicular and capacitive polarities have been mated, before the capacitor is discharged.

35 Claims, 3 Drawing Sheets

CAPACITIVE REMOTE VEHICLE STARTER

CROSS-REFERENCES TO RELATED APPLICATIONS

This application claims priority under 35 U.S.C. §119 (e) to, and hereby incorporates by reference, U.S. Provisional Application No. 60/191,963, filed Mar. 24, 2000.

TECHNICAL FIELD

The present invention relates to remote starters used primarily with vehicles. More particularly, the present invention relates to a remote starter that is useful with engines presenting a high load such as very large gasoline engines and diesel engines.

BACKGROUND OF THE INVENTION

Remote vehicle starting is known in the industry. Principally in areas where cold weather is encountered, remote starting units may be installed on responding vehicles, including emergency vehicles, tow trucks, and the like. Such starting units are typically of a size that they are readily transportable by a responding vehicle, but remain installed on the vehicle while the vehicle's engine is started. Cables are typically utilized to electrically connect the remote vehicle starter with the battery of the vehicle. This is a particular problem for firms having a fleet of vehicles that must be routinely started in cold weather.

Presently, remote starting units are essentially battery chargers. Accordingly, the starting unit may have a relatively small gasoline engine driving a generator or an alternator or a plurality of generators or alternators. Starting units may also include a single charged battery or several charged batteries linked together in parallel or series. This could be a hand carried unit or a wheeled unit. These starting units are coupled by cables to the stalled vehicle battery and are usually used to recharge the battery of the stalled vehicle. The starting unit is then kept connected to the recharged stalled vehicle battery during any attempt to start the stalled vehicle engine in order to boost the output of the minimally recharged stalled vehicle battery.

One problem with current remote vehicle starting units is that they take a certain amount of time to impart a charge to the batteries of stalled vehicles. The charge on such batteries is typically substantially dissipated. Usually, once the responding vehicle arrives at the scene of the stalled vehicle, the remote vehicle starting unit is connected to the battery of the stalled vehicle. Then, charging the battery of the stalled vehicle takes a period of five minutes or more. After an initial recharge of the stalled vehicle's battery is complete, an attempt is usually made to start the engine of the stalled vehicle. The delay encountered while the stalled vehicle's battery is being initially recharged is often frustrating to both the operator of the responding vehicle and the owner/operator of the stalled vehicle. A capability to instantaneously start the stalled vehicle engine after the starting unit is connected to the remote vehicle starter would be very desirable.

A further limitation of existing remote starting units is that, while generally adequate for starting the relatively small gasoline powered engines of passenger vehicles, such remote starting units are significantly less effective in starting engines that present a significant starting load. Such engines may include large gasoline powered engines or diesel engines of any size.

There is a then need in the industry then for a remote vehicle starting unit capable of starting the engine of a stalled vehicle substantially instantaneously and further having the capability to start engines that present high starting loads such as large gasoline engines and diesel engines.

DETAILED DESCRIPTION OF THE DRAWINGS

Figure 1:
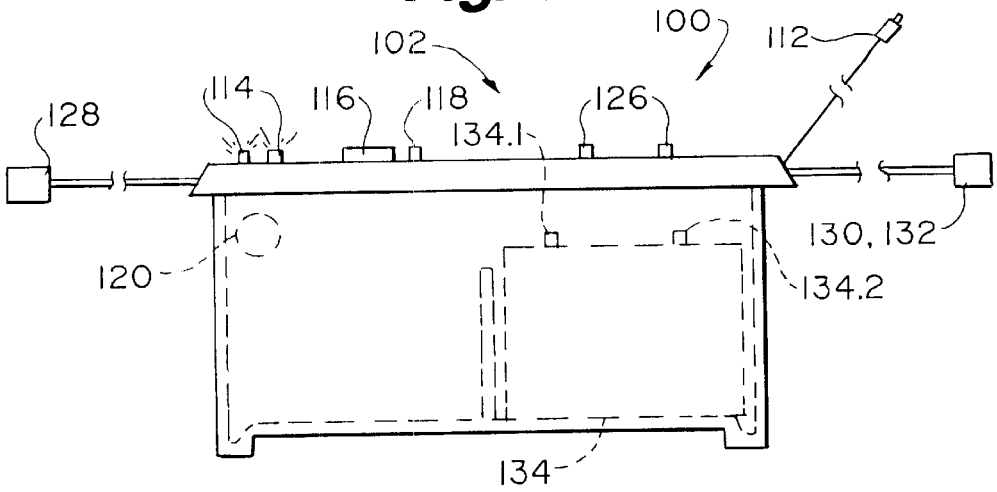
FIG. 1 is a perspective view of the present capacitive remote vehicle starter installed in a box type housing.
Figure 2:
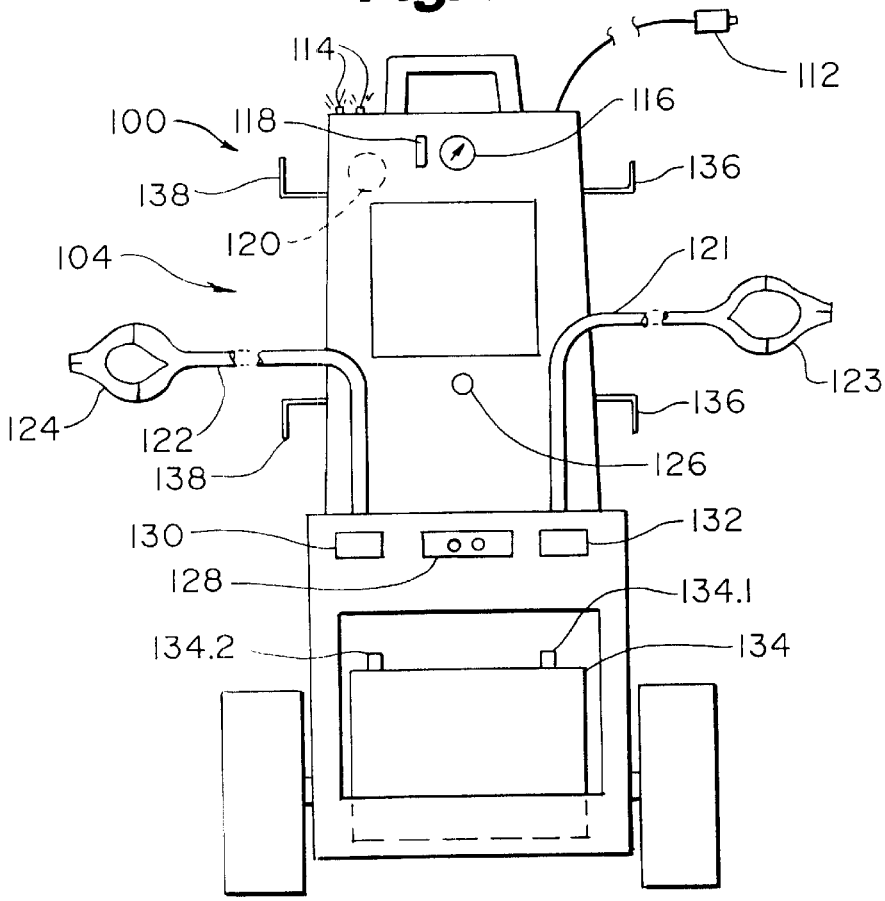
FIG. 2 is a perspective view of the present capacitive remote vehicle starter installed in a portable cart housing.

Referring to FIGS. 1 and 2, one embodiment of the capacitive remote vehicle starter of this invention is indicated generally at 100. Specifically in FIGS. 1 and 2, the present capacitive remote vehicle starter is installed in a box type housing 102 and a portable cart housing 104, respectively and includes a remote activation switch 112, a set of polarity indicator lights 114, a voltmeter 116, a voltmeter switch 118, a polarity warning buzzer 120, cables, 121 and 122 (not shown in FIG. 1), cable clamps 123 and 124 (not shown in FIG. 1), capacitor charging lugs 126, a capacitor charging plug 128, a 12V and an optional 24V outlet plug 130 and 132, and one or more capacitive energy storage devices 134 with poles 134.1 and 134.2 (with opposing, e.g., positive and negative polarities). The cables 121 and 122 can be stowed by being wrapped around brackets 136 and 138 mounted on the portable cart 104 depicted in FIG. 2. The remote activation switch 112 closes a circuit, thereby transferring power from the charged capacitor 134 to the vehicle starting circuitry, via the cables 121 and 122 and cable clamps 123 and 124. One suitable embodiment of the switch 112 is rated at a capacity of 500 amps and includes a relay proximate the capacitor. While a remote switch 112 is indicated in FIGS. 1 and 2, the switch 112 can be located at any suitable location, e.g., proximate the voltmeter switch 118. An advantage of the remote switch 112 is that the operator can be seated in the cab of the vehicle to be started and can activate the starter 100 from this position.

One continuing concern in starting vehicles by supplying power with the present invention is that the cable clamps be correctly connected to electrical components of like polarities. In view of the amount of current being transferred, the ignition systems of the vehicles and the circuitry and/or capacitor of the present starter could be severely damaged if connections to incorrect polarities were made. To this end, correct or incorrect connections are indicated by polarity indicator lights 114. Incorrect connections are further indicated by the polarity warning buzzer 120. The present polarity indicator lights illuminate to show whether the polarities are correctly connected before the switch is activated to transfer power to the vehicle. Moreover, the polarity warning buzzer is sounded if the clamps are attached to vehicular electrical components of opposite polarities, before power is transferred from the capacitor 134 to the vehicle to be started. In one embodiment, one of the polarity indicator lights 114 is green and one is red. An illuminated green light indicates that the cables are attached to electrical components with the correct polarities. An illuminated red light indicates that the cables are attached to electrical components of opposing, or incorrect, polarities. In one embodiment, polarity protection circuit is present to protect the capacitor relay. The protection circuit will not allow relay to close and an audible and/or visual cue, such as a horn or lights, are indications that polarity is wrong.

The voltmeter 116 indicates capacitor voltage. The voltmeter switch 118 closes the circuit between the voltmeter 116 and the capacitor 134. The voltmeter switch 118 may be a two-position switch to prevent depletion of the energy stored in the capacitor when not used for an extended period of time. Alternatively, a three-position switch may be used so that a user can determine the battery power levels of vehicles, before, during, and after being started as well as the capacitor voltage.

The present capacitor(s) 134 usually need to be enclosed in a housing for safety and utility. In the embodiment of FIG. 1, the present starter is housed is a portable housing 102. The housing 102 is suitable for being placed, e.g., in a truck, along with a power source (see below). The truck can then be driven to a convenient location proximate the vehicle to be started. The embodiment of FIG. 2 shows a portable cart type housing, which can be manually conveyed to a desired site by the user. In each embodiment, the capacitor terminals therewithin are usually not readily accessible to users.

Power from the capacitor(s) 134 is transferred to the vehicle to be started by the cables 121 and 122 and cable clamps 123 and 124. The electrical conductors in the cables are capable of transmitting 1800 amps at 12V or 1000 amps at 24V in some embodiments.

The present capacitor(s) are contemplated to have capacities between about 30 and 380 kilojoules to start vehicles such as automobiles, light and heavy trucks (including trucks with gasoline and diesel engines), off road equipment and other pieces of equipment.

The present invention can be used to start vehicles 1) by itself (after being charged), 2) in conjunction with a battery, and 3) in conjunction with a generator. It is understood that the term "power source" is contemplated to include any device which can charge the capacitor(s) of the present invention to a level which will enable a vehicle with an otherwise inadequate battery charge to be started. By way of illustration and not limitation, the power source used in conjunction with the present starter is contemplated to include batteries, generators, alternators and other capacitors. In the first scenario the capacitor is first charged, then disconnected from the power source, finally being electrically connected to the vehicle to be started. The second scenario encompasses a power source such as one or more batteries electrically connected to (in electrical communication with) the present capacitor while a vehicle is being started. The third scenario includes a generator electrically connected to the present capacitor while a vehicle is being started. In the first scenario, the capacitor discharges only previously stored power directly or indirectly to the vehicle ignition system. In the second and third scenarios, the capacitor is recharged as it discharges during the starting procedure.

Figure 3:
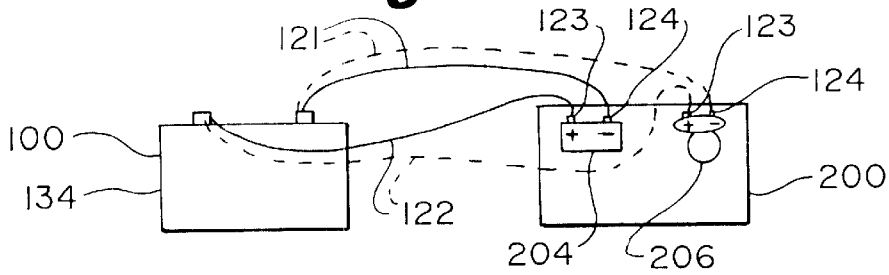
FIG. 3 is a schematic representation of the present capacitive remote vehicle starter electrically connected to the battery or the starter of a vehicle to be started.
Figure 4:
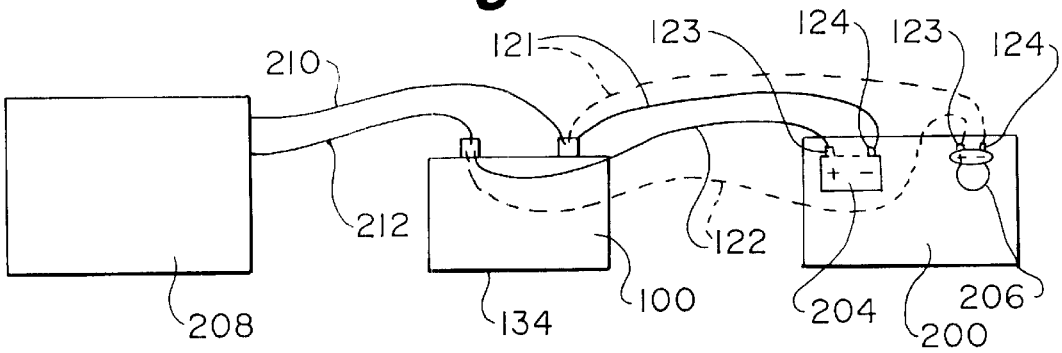
FIG. 4 is a schematic representation of the present capacitive remote vehicle starter electrically connected to the battery or starter of a vehicle to be started and being used in conjunction with a first power source.
Figure 5:
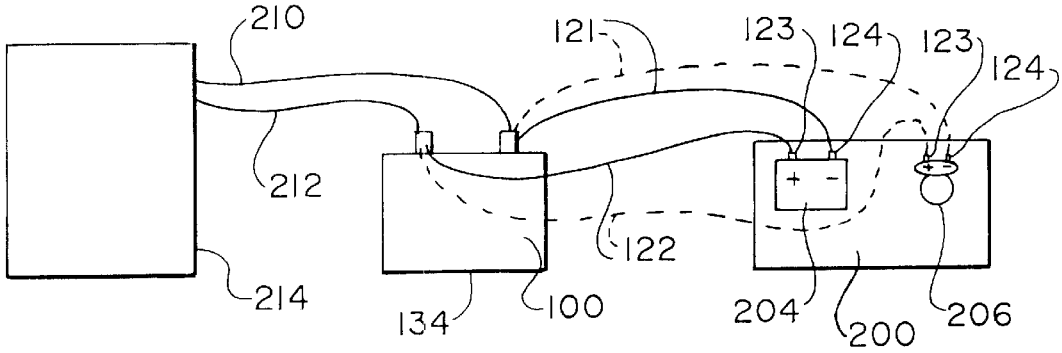
FIG. 5 is a schematic representation of the present capacitive remote vehicle starter electrically connected to the battery or starter of a vehicle to be started and being used in conjunction with a second power source.

Referring to FIGS. 3–5, the above-referenced scenarios are depicted. The capacitor 134 of capacitive remote vehicle starter 100 is connected to a load 200, such as a vehicle to be started, by the cables 121 and 122 and clamps 123 and 124. The cables 121 and 122 and clamps 123 and 124 are depicted as being connected either to poles on a battery 204 or components of a starter 206 on the vehicle 200. In FIG. 3, the capacitor 134 has been previously charged by a power source and can discharge either to the battery 204 or directly to the starter 206. After the vehicle 200 has been started, the capacitor 134 may need to be recharged before another vehicle is started. The started vehicle can serve to recharge the capacitor, if the started vehicle remains electrically connected to the capacitor 134.

In FIG. 4, the present capacitive remote vehicle starter 100 is connected to a load as described above and is additionally connected to a power source, in this case one or more batteries 208, by cables 210 and 212. The one or more batteries 208 may be either 12V or 24V and may be operably coupled together, e.g., in parallel. The batteries may be disposed in a rechargeable device, such as that denoted as BOOST ALL™, available from Goodall Manufacturing, LLC, Eden Prairie, Minn. The batteries within the power source 208 may be maintained in a fully charged state by various external means known to the art. The power source (substantially fully charged one or more batteries) is transported by the responding vehicle, or otherwise conveyed, to the site of the vehicle 200 to be started. The batteries 208 may be directly coupled to the stalled vehicle in order to directly jump-start the stalled vehicle in the manner of the prior art. Alternatively, the power source 208 is used to provide a source of electricity to recharge the capacitors 134 in the present capacitive remote vehicle starter 100. The vehicle 200 will be started more quickly and reliably because the capacitors 134 in the present capacitive remote vehicle starter 100 are maintaining in a charged state. The capacitor of the present remote vehicle starter can be electrically connected either to the battery 204 or the starter 206 of the vehicle 200 to be started.

Referring particularly to FIG. 5, the present capacitive remote vehicle starter may be used in conjunction with a generator 214 as a power source. The generator 214 is electrically connected to the capacitor 134 of the present remote vehicle starter 100 by power cords 210 and 212. The generator 214 may include a fuel-fired engine or a hydraulically-powered motor, the engine or motor powering one or more DC generators and/or alternators to generate power for recharging the present capacitors. The capacitor 134 of the remote vehicle starter 100 is maintained in a continually charged state to provide faster, more reliable power to start the vehicle 200. The present remote starter may be transported on a responding vehicle in a charged condition. Upon arrival at the site of the stalled vehicle 200, a high amount of energy is available to be instantaneously transmitted to the battery 204 or to be starter 206 of the vehicle 200. Because the generator 214 is electrically coupled thereto (or in electrical communication therewith), the present remote vehicle starter continues to boost the energy supplied to the stalled vehicle 200 during a starting procedure. Suitable engine driven or hydraulically driven generators are available as START ALL™ from Goodall Manufacturing, LLC, Eden Prairie, Minn.

Figure 6:
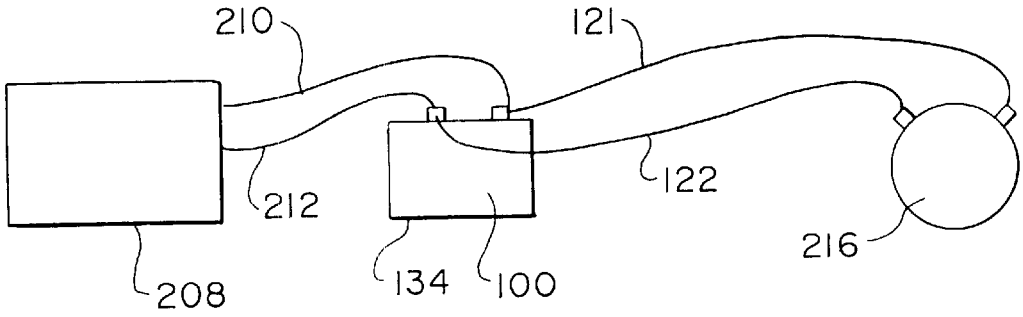
FIG. 6 is a schematic representation of a test fixture for testing the embodiment of FIG. 4.

A number of tests have been conducted to ensure the efficacy of the remote vehicle starter 100 of the present invention. Referring to FIG. 6, the power source 208, as described with reference to FIG. 4, is utilized in conjunction with a 70 kilojoule capacitor comprising the capacitive energy storage device 134. The test included charging the capacitive energy storage device 134 to 14 volts. The cables 210 and 212 were then removed from the capacitive energy storage device 134. The capacitive energy storage device 134 was then connected to a 200 amp fixed load 216 by means of the second set of cables 121 and 122 and clamps 123 and 124. The power stored in the capacitive energy storage device 134 was then discharged to the fixed load 216. It was observed that 200 amps of power at 14.2 volts was measured at the fixed load 216 initially. This reading declined to 170 amps at 10.5 volts after the capacitive energy storage device 134 was connected to the fixed load 216 for a duration of 20 seconds.

Figure 7:
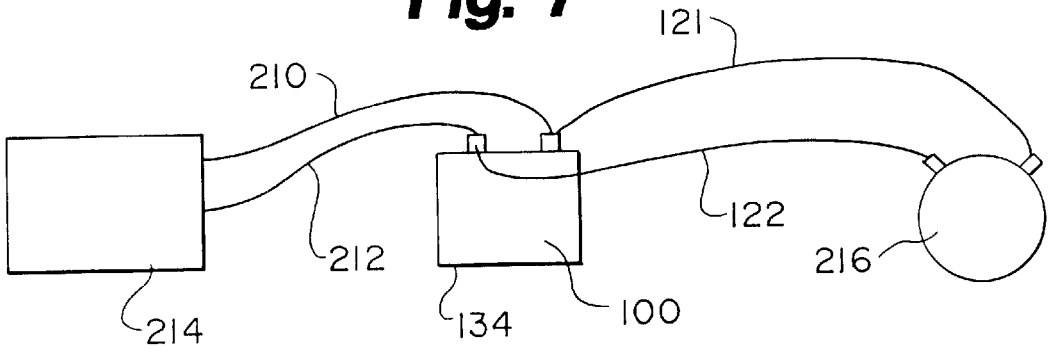
FIG. 7 is a schematic representation of a test fixture for testing the embodiment of FIG. 4.

Referring to FIG. 7, a power source 214, as described with reference to the embodiment of FIG. 5, was connected by cables 210 and 212 to the capacitive energy storage device 134. In this case, the capacitive energy storage device 134 was also a 70 kilojoule capacitor. After charging the capacitive energy storage device 134 to 14.2 volts, the cables 210 and 212 were disconnected from the capacitive energy storage device 134. The capacitive energy storage device 134 was then connected to the fixed load 216 by means of the second set of cables 121 and 122 and clamps 123 and 124 and discharged. Two hundred amps of power at 14.2 volts were initially observed at the fixed load 216, declining to 170 amps at 10.5 volts after 23 seconds of connection.

A further test was conducted using the embodiment of FIG. 7. In this case, the power source 214 remained connected to the capacitive energy storage device 134 during the discharge of the capacitive energy storage device 134 to the load 216. There was a significant boost to the starting operation, noted by maintaining the power source 208 connected to the capacitive energy storage device 134 during the discharge. Initially, it was observed that 200 amps of power at 14.2 volts were measured at the load 216. This declined to only 170 amps at 10.5 volts after 55 seconds of connection to the load 216.

Figure 8:
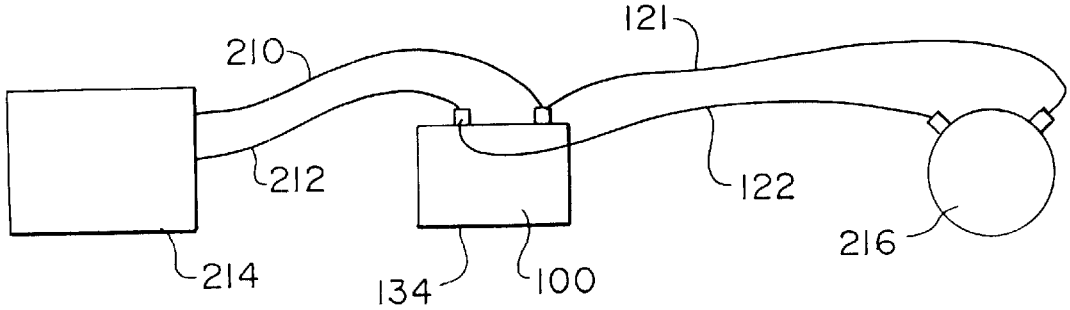
FIG. 8 is a schematic representation of a test fixture of the embodiment of FIG. 5 with a load simulating a high load starting requirement.

A yet further test was conducted as depicted in FIG. 8, in which a substantially greater fixed 1000 amp load 218 was utilized in order to simulate the starting load of a relatively large diesel or gasoline engine. In this case, the power source 214 was the power source as described with reference to FIG. 5, above. The capacitive energy storage device 134 was again a 70 kilojoule capacitor. In order to conduct the test, the capacitive energy storage device 134 was charged to 14.2 volts by the power source 214. The power source 214 was then left connected when the capacitive energy storage device 134 was discharged. Initially, it was observed that 1000+ amps at 14.2 volts were available at the load 218. The power declined to only 750 amps at 10.5 volts at the load five seconds after being connected to the load 218.

The series of tests described above with reference to FIGS. 6–8 demonstrate the usefulness of the capacitive remote vehicle starter 100 of the present invention. While the tests used a 70 kilojoule capacitor for the capacitive energy storage device 134, a smaller or larger capacitive energy storage device 134 may also be useful under certain circumstances. One advantage of a smaller capacitive energy storage device 134 (used primarily to start gasoline powered passenger vehicles) would be that the smaller capacity reduces the weight of the capacitive energy storage device 134, hence potentially the weight of the present capacitive starter. The reduced weight potentially allows for easier transport of the capacitive remote vehicle starter 100 to the proximity of the vehicle to be started 100 in order to minimize the length (therefore the resistance) of the cables 121 and 122, which connect the capacitive energy storage device 134 to the vehicle 200. On the other hand, a larger capacitive energy storage device 134 may be useful with a capacitive remote vehicle starter 100 for used primarily for starting heavy duty trucks or when temperatures are extremely cold (e.g., −20° F. to −40° F.). Such trucks typically have relatively large diesel engines with very high starting loads. The capacitive energy storage device 134 for use with such a capacitive remote vehicle starter 100 may be as large as 380 kilojoules in some embodiments.

The power source 214, as described above with reference to FIG. 8, may be a five horsepower, one generator model. However, is anticipated that it may be advantageous to use significantly higher horsepower ratings for the engine of the power source 214, in conjunction with several generators/alternators to more fully and quickly charge the capacitors of the capacitive energy storage device 134 for use with high amperage requirements. Such a large unit additionally adds power to augment the power of available from the capacitive energy storage device 134.

Because numerous modifications of this invention may be made without departing from the spirit thereof, the scope of the invention is not to be limited to the embodiments illustrated and described. Rather, the scope of the invention is to be determined by the appended claims and their equivalents.

What is claimed is:

1. A portable capacitive remote vehicle starter for supplying auxiliary power for jump starting a vehicle, comprising:

a capacitor enclosed in a portable housing;

a first and a second electrical conductor, selectively attachable to a starting system on the vehicle;

a switching mechanism independent of the vehicle starting system to discharge electric current from the capacitor, through the electrical conductors, to the starting system on the vehicle, the switching mechanism further comprising a polarity protection circuit to prevent the switching mechanism from discharging the capacitor if the first and second electrical conductors are attached to the starting system at a reversed polarity;

a remote switch to selectively activate the switching mechanism, the remote switch being transportable independent of the portable housing to allow activation of the switching mechanism from a substantial distance from the portable housing; and an external power source operably coupled to the capacitor independently of the vehicle starting system for providing electrical power to the capacitor prior to and during a vehicle starting event.

2. The portable capacitive remote vehicle starter of claim 1, in which a plurality of capacitors is present.

3. The portable capacitive remote vehicle starter of claim 1, the capacitor with a charging capacity of between about 70 kilojoules and 380 kilojoules.

4. The portable capacitive remote vehicle starter of claim 1, the external power source being selected from a list consisting of a battery, a motor-driven alternator, and a motor-driven generator, the motor being either hydraulic or internal combustion.

5. The portable capacitive remote vehicle starter of claim 1, the switching mechanism comprising a relay.

6. The portable capacitive remote vehicle starter of claim 1, in which the switching mechanism includes a switch with a capacity of 500 amps.

7. The portable capacitive remote vehicle starter of claim 1, further comprising a voltmeter and a voltmeter switch, the voltmeter registering the charged capacitor potential, the voltmeter switch opening and closing a circuit between the voltmeter and the capacitor.

8. The portable capacitive remote vehicle starter of claim 7, in which the voltmeter switch comprises a two-position switch or a three-position switch.

9. The portable capacitive remote vehicle starter of claim 1, the capacitor including first and second poles with respective first and second polarities and in which the first and second electrical conductors are electrically connected to the first and second capacitor poles and further comprising a polarity warning light, said polarity warning light illuminating when the first electrical conductor is connected to a vehicular battery pole or starter component of the second polarity and the second electrical conductor is connected to a vehicular battery pole or starter component of the first polarity.

10. The portable capacitive remote vehicle starter of claim 1, the capacitor including first and second poles with respective first and second polarities and in which the first and second electrical conductors are electrically connected to the first and second capacitor poles and further comprising first and second polarity warning lights, said first polarity warning light illuminating when the first electrical conductor is connected to a vehicular battery pole or starter component of the first polarity and the second electrical conductor is connected to a vehicular battery pole or starter component of the first polarity, the second polarity warning light illuminating when the first electrical conductor is connected to a vehicular battery pole or starter component of the second polarity and the second electrical conductor is connected to a vehicular battery pole or starter component of the first polarity.

11. The portable capacitive remote vehicle starter of claim 1, in which the first and second electrical conductors are electrically connected to capacitor poles with respective first and second polarities and further comprising an audible warning, the audible warning being actuated when the first electrical conductor is connected to a vehicular battery pole or starter component of the second polarity and the second electrical conductor is connected to a vehicular battery pole or starter component of the first polarity.

12. The portable capacitive remote vehicle starter of claim 1, the external power source recharging the capacitor as the capacitor discharges during a vehicle starting event.

13. The portable capacitive remote vehicle starter of claim 1, wherein the external power source is a generator or alternator, the generator or alternator operably connected to a fuel-fired engine or a hydraulically powered motor independent of the vehicle, said generator or alternator being in electrical communication with the capacitor during a vehicular starting event.

14. The portable capacitive remote vehicle starter of claim 1, in which the first and second electrical conductors are connectable to a vehicular battery.

15. A method of supplying external auxiliary power for starting a vehicle, comprising:

transporting a portable auxiliary capacitive remote vehicle starter to within close proximity of the vehicle connecting first and second conductors from the portable auxiliary capacitive remote vehicle starter to a starting system of the vehicle;

protecting the portable auxiliary capacitive remote vehicle starter with a polarity protection circuit to prevent the switching mechanism from discharging a capacitor if the first and second electrical conductors are attached to the starting system at a reversed polarity;

discharging the capacitor through the electrical conductors to the vehicular starting system; operably coupling a power source independent of the vehicle to the capacitor for providing electrical power to the capacitor prior to and during a vehicle starting event; and actuating the vehicular starting system to start the vehicle; and simultaneously activating a remote switch to initiate the discharge of the capacitor.

16. The method of claim 15, in which the vehicle includes a battery and further comprising the step of connecting the first and second conductors to the vehicle battery.

17. The method of claim 15, in which the vehicle includes a starter and further comprising the step of connecting the first and second conductors to the vehicle starter.

18. The method of claim 15, in which the external power source comprises a battery power source connected to the capacitor.

19. The method of claim 15, a in which the external power source comprises a motor-driven generator power source connected to the capacitor.

20. The method of claim 15, in which the external power source comprises a motor-driven alternator power source connected to the capacitor.

21. The method of claim 15, in which the capacitor is discharged while starting a vehicle and is simultaneously at least partially recharged by being electrically connected to the external power source.

22. An external portable capacitive remote vehicle starter for supplying power for jump starting a vehicle, comprising:

a capacitor enclosed in a portable housing;

a first and a second electrical conductor, selectively attachable to a starting system on the vehicle;

a switching mechanism independent of the vehicle starting system to discharge electric current from the capacitor, through the electrical conductors, to the starting system on the vehicle, the switching mechanism further comprising a polarity protection circuit to prevent the switching mechanism from discharging the capacitor if the first and second electrical conductors are attached to the starting system at a reversed polarity;

a remote switch to selectively activate the switching mechanism, the remote switch being transportable independent of the portable housing to allow activation of the switching mechanism from a substantial distance from the portable housing; and an external power source operably coupled to the capacitor independently of the vehicle starting system for providing electrical power to the capacitor prior to and during a vehicle starting event, the power source being a battery.

23. The external portable capacitive remote vehicle starter of claim 22, in which a plurality of capacitors is present.

24. The external portable capacitive remote vehicle starter of claim 22, the capacitor having a charging capacity of between about 70 kilojoules and 380 kilojoules.

25. The external portable capacitive remote vehicle starter of claim 22, the switching mechanism comprising a relay.

26. The external portable capacitive remote vehicle starter of claim 22, in which the switching mechanism includes a switch with a capacity of 500 amps.

27. The external portable capacitive remote vehicle starter of claim 22, further comprising a voltmeter and a voltmeter switch, the voltmeter registering the charged capacitor potential, the voltmeter switch opening and closing a circuit between the voltmeter and the capacitor.

28. The external portable capacitive remote vehicle starter of claim 22, further comprising a polarity warning light, said polarity warning light illuminating when the first electrical conductor is connected to a vehicular battery pole or starter component of the second polarity and the second electrical conductor is connected to a vehicular battery pole or starter component of the first polarity.

29. An external capacitive remote vehicle starter for supplying power for jump starting a vehicle, comprising:

a capacitor enclosed in a portable housing;

a first and a second electrical conductor, selectively attachable to a starting system on the vehicle;

a switching mechanism independent of the vehicle starting system to discharge electric current from the capacitor, through the electrical conductors, to an starting system on the vehicle, the switching mechanism further comprising a polarity protection circuit to prevent the switching mechanism from discharging the capacitor if the first and second electrical conductors are attached to the starting system at a reversed polarity;

a remote switch to selectively activate the switching mechanism, the remote switch being transportable independent of the portable housing to allow activation of the switching mechanism from a substantial distance from the portable housing; and an external power source operably coupled to the capacitor independently of the vehicle starting system for providing electrical power to the capacitor prior to and during a vehicle starting event, the power source being a motor-driven generator or alternator.

30. The external capacitive remote vehicle starter of claim 29, in which a plurality of capacitors is present.

31. The external capacitive remote vehicle starter of claim 29, the capacitor with a charging capacity of between about 70 kilojoules and 380 kilojoules.

32. The external capacitive remote vehicle starter of claim 29, the switching mechanism comprising a relay.

33. The external capacitive remote vehicle starter of claim 29, in which the switching mechanism includes a switch with a capacity of 500 amps.

34. The external portable capacitive remote vehicle starter of claim 29, further comprising a voltmeter and a voltmeter switch, the voltmeter registering the charged capacitor potential, the voltmeter switch opening and closing a circuit between the voltmeter and the capacitor.

35. The external portable capacitive remote vehicle starter of claim 29, further comprising a polarity warning light, said polarity warning light illuminating when the first electrical conductor is connected to a vehicular battery pole or starter component of the second polarity and the second electrical conductor is connected to a vehicular battery pole or starter component of the first polarity.

* * * * *

UNITED STATES PATENT AND TRADEMARK OFFICE

CERTIFICATE OF CORRECTION

PATENT NO. : 6,679,212 B2
DATED : January 20, 2004
INVENTOR(S) : Kelling

It is certified that error appears in the above-identified patent and that said Letters Patent is hereby corrected as shown below:

Column 1,
Line 65, delete “is a then” and insert -- is, then, a --; after “industry” delete “then”.

Column 2,
Line 39, after “cables” delete “,”.
Line 44, delete “e.g.,” and insert -- i.e. --.

Column 3,
Line 58, after “source” insert -- and --.

Column 6,
Line 6, delete “used” and insert -- use --.
Line 21, delete “of”.

Column 7,
Line 27, delete the paragraph break after “connected”.
Line 59, after “for” insert -- jump --.

Column 8,
Line 6, insert a paragraph break after “system;”.
Line 22, after “15,” delete “a”.

Column 9,
Line 18, delete “an” and insert -- a --.

UNITED STATES PATENT AND TRADEMARK OFFICE

CERTIFICATE OF CORRECTION

PATENT NO. : 6,679,212 B2
DATED : January 20, 2004
INVENTOR(S) : Kelling

It is certified that error appears in the above-identified patent and that said Letters Patent is hereby corrected as shown below:

Column 10,
Lines 16 and 21, delete "portable".

Signed and Sealed this

Twenty-first Day of June, 2005

JON W. DUDAS
*Director of the United States Patent and Trademark Office*